US007731066B2

(12) United States Patent
Norris et al.

(10) Patent No.: US 7,731,066 B2
(45) Date of Patent: Jun. 8, 2010

(54) CLOSURE

(75) Inventors: Joseph T. Norris, West Windsor, NJ (US); John C. Crawford, Mahopac, NY (US); Scott Murray Walsh, Langhorne, PA (US); Alan Patrick Hickok, Waukesha, WI (US); Kelly Ann Smith, East Troy, WI (US)

(73) Assignee: Colgate-Palmolive Company, New York, NY (US)

( * ) Notice: Subject to any disclaimer, the term of this patent is extended or adjusted under 35 U.S.C. 154(b) by 640 days.

(21) Appl. No.: 11/197,205

(22) Filed: Aug. 4, 2005

(65) Prior Publication Data

US 2007/0029352 A1 Feb. 8, 2007

(51) Int. Cl.
*B65D 5/72* (2006.01)

(52) U.S. Cl. ..... 222/494; 222/490; 222/556

(58) Field of Classification Search ..... 222/494, 222/1, 546, 206, 212–213, 490, 556, 491; 251/85, 331; 215/232; 137/849, 846
See application file for complete search history.

(56) References Cited

U.S. PATENT DOCUMENTS 4,749,108 A * 6/1988 Dornsbusch et al. ..... 222/212
5,033,655 A 7/1991 Brown
5,236,107 A 8/1993 Spaanstra, Sr.
5,271,531 A * 12/1993 Rohr et al. ..... 222/212
5,346,107 A * 9/1994 Bouix et al. ..... 222/490
5,353,970 A 10/1994 Stull et al.
5,390,805 A 2/1995 Bilani et al.
5,632,420 A 5/1997 Lohrman et al.

(Continued)

FOREIGN PATENT DOCUMENTS

EP 0 885 813 A2 12/1998

(Continued)

*Primary Examiner*—Kevin P Shaver
*Assistant Examiner*—Robert K Nichols II
(74) *Attorney, Agent, or Firm*—Amy M. Fernandez

(57) ABSTRACT

There is disclosed a closure comprised of a valve, a base unit and an upper unit. The base unit has a base surface with a peripheral skirt. The base surface has an aperture with a cylindrical section extending above and below the base surface. The cylindrical section has an aperture therethrough. The upper unit has an upper surface and an aperture adapted to align with the aperture of the cylindrical section of said base unit. The upper unit has a lid to cover the apertures in the base unit cylindrical section and the upper unit. A lid inner top surface has two projecting seals, one to maintain the valve closed when the lid is closed and the other to provide a seal when the lid is closed. and a latch mechanism attaches the base unit to the upper unit. A preferred latch mechanism comprises a projection and an interfitting recess, one being on the base section and the other on the upper section. The lid top surface preferably has an essential horizontal top surface. In a preferred embodiment the valve is a polymeric valve located in the aperture between the base unit and the upper unit and held in place by contact with both the base unit and the upper unit. The rheology of the product in the container and the characteristics of the valve are coordinated so that the product will be fully contained by the valve regardless of the orientation of the container, including being inverted.

19 Claims, 8 Drawing Sheets

U.S. PATENT DOCUMENTS

| | | | | |
|---|---|---|---|---|
| 5,743,443 | A | 4/1998 | Hins | |
| 5,823,387 | A | 10/1998 | Manadanas et al. | |
| 5,897,033 | A | 4/1999 | Okawa et al. | |
| 5,927,566 | A | 7/1999 | Mueller | |
| 5,927,567 | A * | 7/1999 | Fillmore | 222/490 |
| 5,934,514 | A | 8/1999 | Lampe et al. | |
| 5,938,086 | A | 8/1999 | Gross | 222/494 |
| 5,944,234 | A | 8/1999 | Lampe et al. | |
| 5,971,232 | A | 10/1999 | Rohr et al. | |
| 6,089,411 | A | 7/2000 | Baudin et al. | |
| 6,089,419 | A | 7/2000 | Gross | |
| 6,112,951 | A | 9/2000 | Mueller | |
| 6,126,923 | A | 10/2000 | Burke et al. | |
| 6,135,318 | A | 10/2000 | Valley | |
| 6,145,707 | A * | 11/2000 | Baudin | 222/189.09 |
| 6,248,339 | B1 * | 6/2001 | Knitowski et al. | 424/401 |
| 6,290,108 | B1 | 9/2001 | Gross | 222/494 |
| 6,672,487 | B1 * | 1/2004 | Lohrman | 222/213 |
| 6,726,063 | B2 | 4/2004 | Stull et al. | |
| 6,745,505 | B2 * | 6/2004 | Moran | 40/311 |
| 6,749,089 | B2 | 6/2004 | Stull et al. | |
| D492,597 | S | 7/2004 | Norris et al. | |
| 6,786,363 | B1 | 9/2004 | Lohrman | |
| 6,880,729 | B2 | 4/2005 | Stull et al. | |
| 2002/0162839 | A1 | 11/2002 | Stull et al. | |
| 2007/0023462 | A1 * | 2/2007 | Pugne | 222/556 |
| 2007/0114250 | A1 * | 5/2007 | Langseder et al. | 222/494 |
| 2008/0110933 | A1 * | 5/2008 | Goncalves | 222/153.05 |

FOREIGN PATENT DOCUMENTS

| | | |
|---|---|---|
| EP | 0 947 440 A1 | 10/1999 |
| WO | WO 95/34500 | 12/1995 |

* cited by examiner

CLOSURE

This invention relates to a closure for a container, the closure being comprised of two units. More particularly this invention relates to a closure for containers which closure contains a valve located between a base unit and an upper unit and wherein the closure provides for a positive seal for the container contents using such a valve.

BACKGROUND OF THE INVENTION

Essentially all containers will have a closure of some type. This can be a cap, a dispensing pump, a dispensing cap, or a cap with an integral valve. This is the case whether the container is a bottle or a tube. The closure can be permanently or removably attached to the container. Some will merely flow the product from a container and others will control the flow from a container. The closures, and the container to be used with a closure, will depend to a large extent on the product that is in the container.

The closure must protect the product prior to and during use. It must prevent components of the product from escaping from the container and prevent external substances from entering the container, prior, during and after use. It also must be easy to use, and if a dispensing closure, must dispense accurate amounts of product and be neat during extended use. There must not be an accumulation of product at the closure exit. Further the closure must be decorative and should be useful with liquid and viscous products. In addition it should provide the option of storing the container during use in various orientations, such as on the closure.

Some of these problems have been addressed in U.S. Pat. No. 5,897,033 which includes a valve to control the flow from a container. The closure is of a single unit structure with the valve being maintained in place using a retaining ring structure. This decreases the decorative options that can be accomplished with at least two units. In addition, the valve structure would need to be modified to a different shape to be effective for dispensing more viscous products. This valve structure is suited for dispensing liquids such as liquid soaps, shampoos and lotions but not for dispensing more viscous products. U.S. Pat. No. 6,672,487 discloses a related closure with a valve structure similar to that of U.S. Pat. No. 5,897,033. The valve in this patent is captured and locked into place by a bead structure in the closure base and the closure collar. Although there is disclosed a two unit structure the closure collar is a relatively small unit and would not provide a sufficient opportunity to further decorate the product package. Further the structure of this valve would have to be modified for dispensing viscous products. It is designed to dispense less viscous products such as beverages, food condiments and body lotions.

U.S. Pat. No. 5,033,655 discloses valves that are useful for dispensing various products. The disclosures are directed primarily to valve structures and not to any specific container or closure structure. The products that can be dispensed using the disclosed valves range from liquid products to viscous products such as toothpastes. U.S. Pat. No. 6,726,063 also discloses a variety of valves that could be engineered to be useful in dispensing various products. However these patents do not disclose a closure structure that can have enhanced decorative features nor any solutions with regard to protecting the contents of the container from a loss of components or contamination from an exterior source during storage The present closures solve these problems and can be used on a range of containers, including tube containers. These closures provide for an ease of use and in a preferred embodiment include a valve designed for better control of the product being dispensed and a valve seal design for enhanced protection of the product prior to and during use. It further minimizes any build-up of product at the closure exit when used with viscous products. Additionally the closure structure is susceptible to enhanced decoration and the outer top surface of the closure can be planar so that the container can be stored inverted and in a ready mode for the next use.

SUMMARY OF THE INVENTION

The present closure is comprised of a valve, a base unit and an upper unit. The base unit has a base unit surface with an aperture therein. Within the base unit there is a structure to attach the base unit to a container. The upper unit has an upper unit surface with an aperture in general alignment with the aperture in the base unit when the upper unit overlays and is secured to the base unit. Attached by a hinge to the upper unit is a lid for closing the aperture in the upper unit and consequently also that of the base unit. The lid preferably has a substantially horizontal top surface so that the closure and an attached tube or other container can be stored inverted. A valve is located between the base unit and the upper unit. The lid on an inner surface has a structure to seal the valve when the lid is in the closed position.

In one embodiment of the closure the valve which controls the flow of product from the container is located on the base unit and is maintained in place by a contact fit between the base unit and the upper unit. A lower surface of the upper unit and an upper surface of base unit contact the valve. In a further embodiment the valve comprises a polymer membrane with one or more slit openings. The material of the valve has a stiffness correlated to the rheology of the product being dispensed. The valve must have properties to maintain a product of a given rheology in the container with the container in any orientation, including being inverted. Further the valve must open upon a pressure being exerted on the container and when the pressure is released close and return to its original closed position, thereby cutting off the flow of the product from the container. This results in neat dispensing during use with little or no product build-up at the valve exit.

Additionally, the closure will provide a positive seal to the valve during periods of storage, whether prior to or during use. The closure/valve structure prevents components of the product in the container from escaping from the container and contaminants from the exterior from entering into the container.

The products will have a viscosity of about 15,000 centipoise to about 90,000 centipoise and preferably about 25,000 centipoise to about 60,000 centipoise. These products include toothpastes. The valve will have a specific gravity of about 1 to 1.2, an elongation of about 400% to about 700% and a tensile strength of about 1200 psi to about 1600 psi.

In a further embodiment the base unit and the upper unit can be of different materials and/or of different colors to enhance the decorative appearance of the container and closure.

DETAILED DESCRIPTION OF THE INVENTION

The closure of this invention will be described in more detail in its preferred embodiments with reference to the Figures. The closure will be shown on a tube container but can be adapted for use on other containers.

Figure 1:
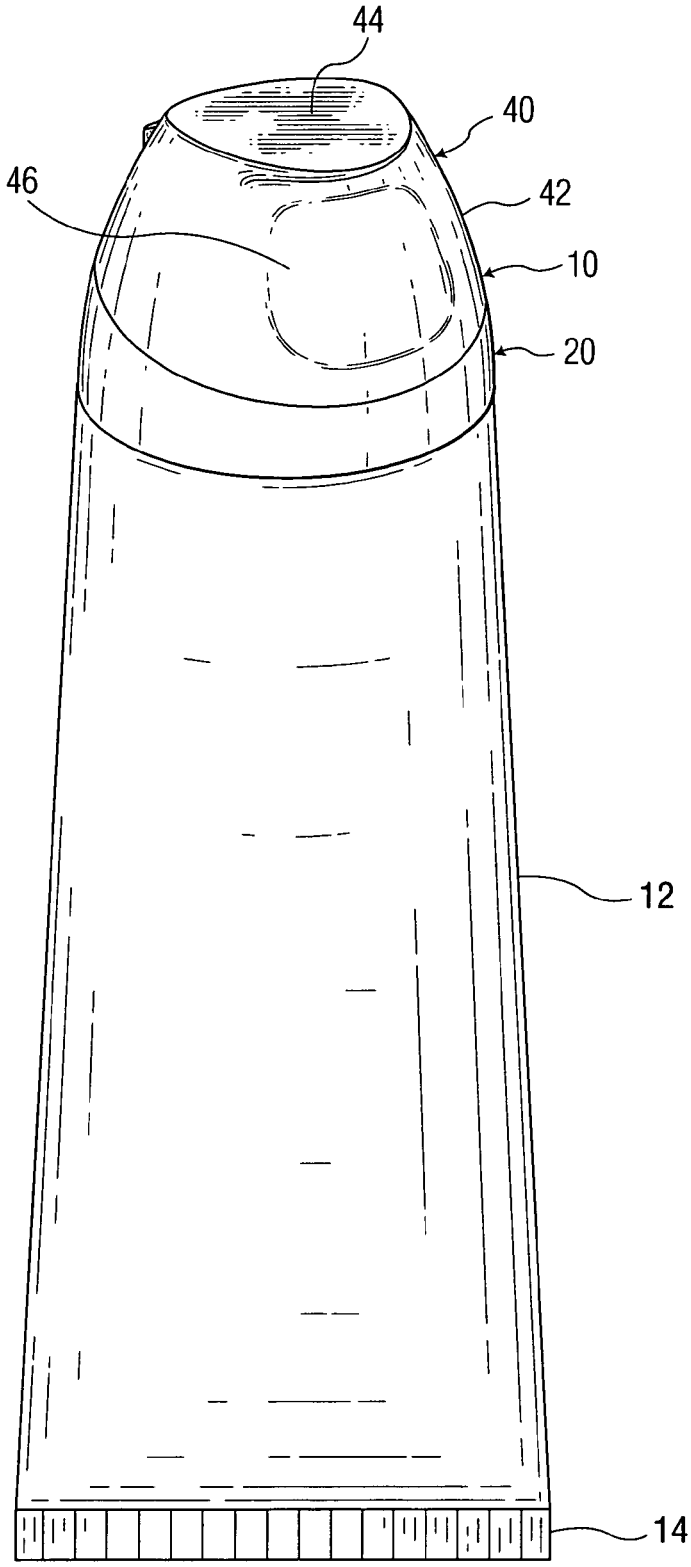
FIG. 1 is a perspective view of the closure on a tube container.

FIG. 1 shows the closure 10 on tube 12 which is closed at the lower end by crimp seal 14. The closure is comprised of lower base unit 20 and upper unit 40. The upper unit has a side surface 42, top surface 44 and an opening grip area 46. The upper unit 40 and lower base unit 20 can be of the same or different colors. For instance the base unit 20 can be the same color as a part of the tube 12. The upper unit top surface 44 is substantially horizontal so that the tube can be stored inverted and standing on the cap top surface.

Figure 2:
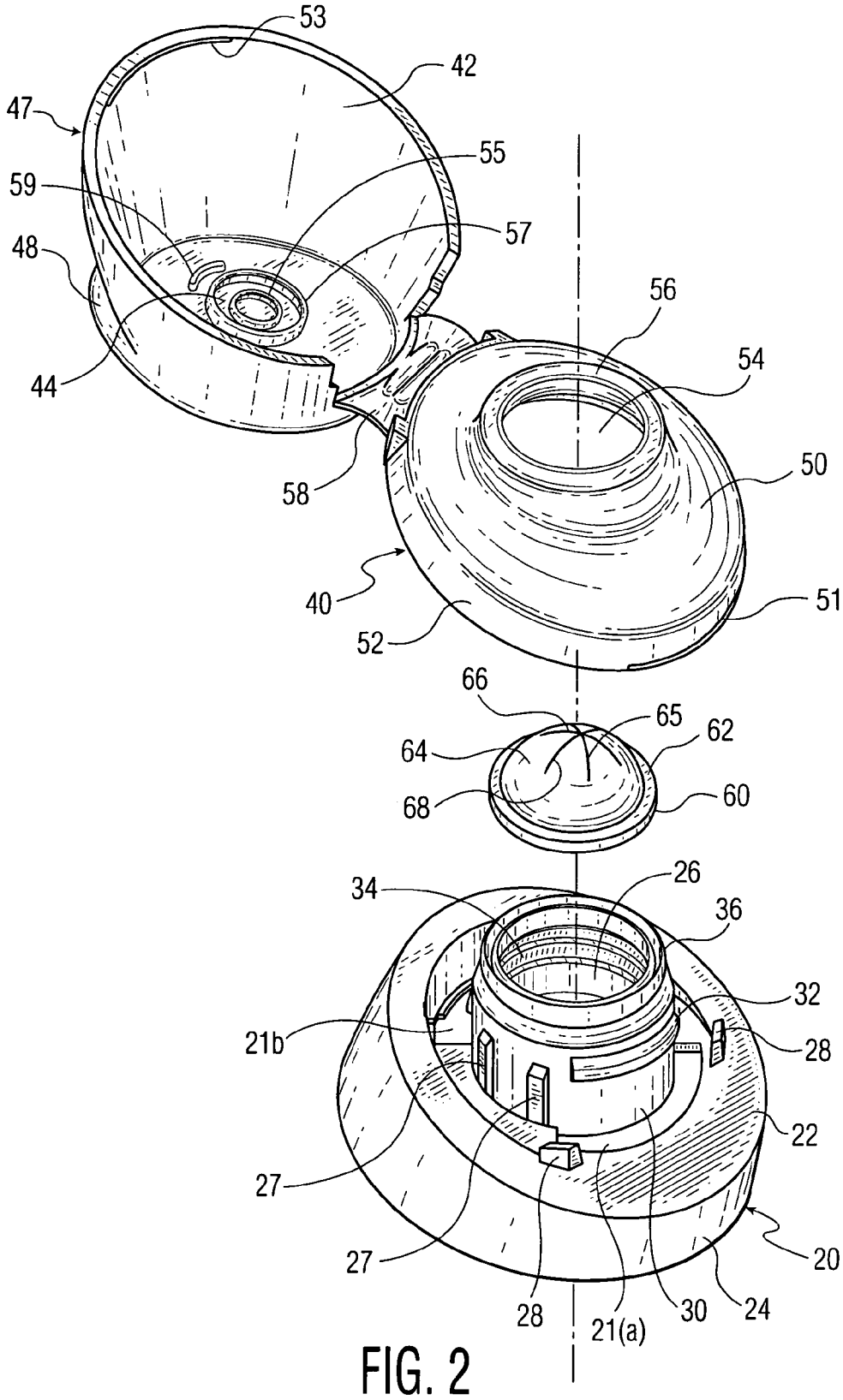
FIG. 2 is an exploded view of the closure.

FIG. 2 shows the closure in an exploded view. The closure 10 is comprised of base unit 20, upper unit 40 and valve 60. The base unit 20 is comprised of base unit surface 22 with depending skirt 24 and an aperture 26. Cylindrical section 30 extends upwardly and downwardly through the base unit surface 22 and defines the structure of aperture 26. On the interior of the cylindrical section 30 are threads 34 for the attachment of the base unit to a tube or other container. The cylindrical section 30 has an upper edge 36 on the periphery of the aperture 26. On the exterior surface of the cylindrical section 30 are guide ledges 28 and projection 32 to attach and lock the upper unit 40 onto base unit 20. The guide ledges 28 orient the upper unit 40 to the base unit 20 as the upper unit 40 is being assembled onto the base unit 20. Vertical supports 27 serve to increase the rigidity of the cylindrical section 30. Areas 21 (*a*) and 21(*b*) are voids in the base unit surface 22. Projection 53 on the lid 47 interacts with projection 51 on the upper unit 40 to hold the lid 47 in a closed position.

The upper unit 40 is comprised of an upper unit surface 50 with a peripheral skirt 52. This upper unit surface 50 has an aperture 54 with peripheral edge 56. The aperture 54 will align with aperture 26 of the base unit when the base unit and upper unit are attached. These apertures usually will be in an axial orientation with a tube container.

The upper unit also comprises a lid 47 which is attached to the upper unit flange by hinge 58. This can be a living or snap hinge. The lid 47 is comprised of sidewall 42 and contiguous top wall 44. Depending from the top wall 44 inner surface are concentric seals 55 and 57. The concentric seal 55 aids in maintaining the valve 60 closed when the lid 47 is in the closed position. Concentric seal 57 contacts the valve 60 between slits 65, 66, and 68 and peripheral flange 62 of the valve to provide a seal with the valve when the lid 47 is closed. Projection 59 contacts edge 56 when closed to provide support to the lid in the closed position. Ledge 48 of the lid is adjacent to grip surface 46 and aids in opening the lid.

The concentric seal 57 forms essentially an air tight seal with the polymeric material of the valve 60. There is a light, but positive contact between seal 57 and the surface of valve 60 between peripheral flange 62 and the slits 65, 66 and 68. Most, and preferably all, of the slits will be within the seal 57 when the lid is in the closed position. This prevents moisture and other product components from escaping from the container during storage, prior to and during use. It also prevents substances from getting into the product and container and contaminating the product.

The valve 60 has a peripheral flange 62 and a curved convex portion 64. The curved convex portion 64 has intersecting slits 65, 66 and 68. There can be from 1 to 10 or more slits. As the number of slits increases the ability to quickly close after a dispensing decreases. However increasing the number of slits decreases to force needed to dispense product from the tube or other container. Consequently the valve materials and structure are related to the rheology of the product in the container. When the closure is assembled the peripheral flange 62 of the valve 60 rests on the aperture edge 36 of the base unit 20. The valve peripheral flange 62 is held in place on cylindrical section edge 36 by contact with the underside of peripheral edge 56 of aperture 54 of the upper unit 40. In essence the peripheral flange 62 of valve 60 is sandwiched between the base unit 20 and the upper unit 40. The valve is maintained in position by the friction contact of the upper edge 36 and the peripheral edge 56. No locking or capturing structure is required.

Figure 3:
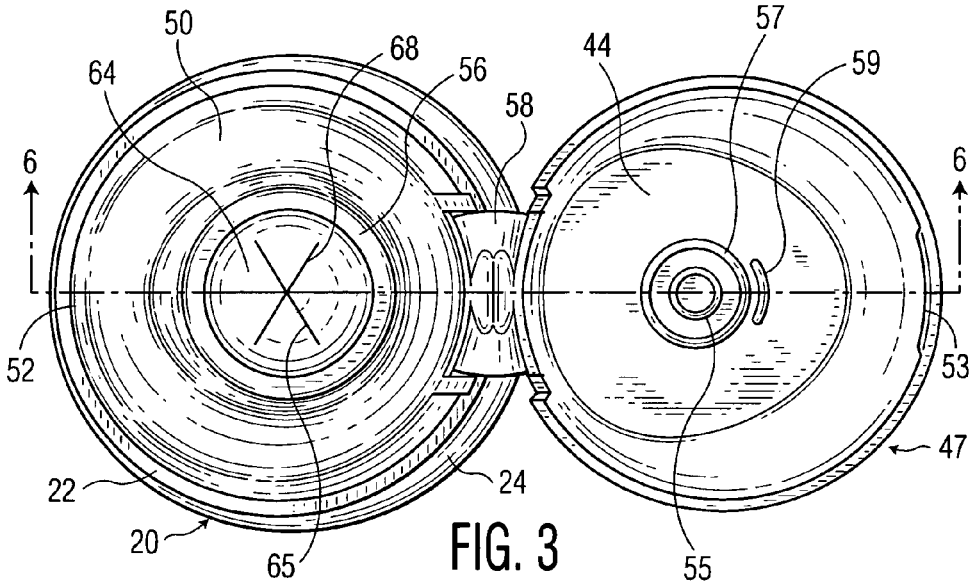
FIG. 3 is a top plan view of the closure opened.
Figure 4:
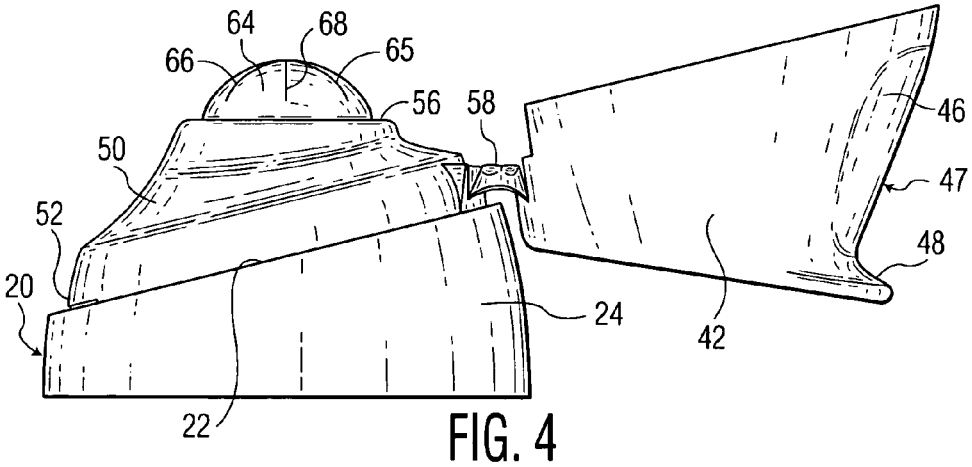
FIG. 4 is a side elevation view of the closure of FIG. 3.
Figure 5:
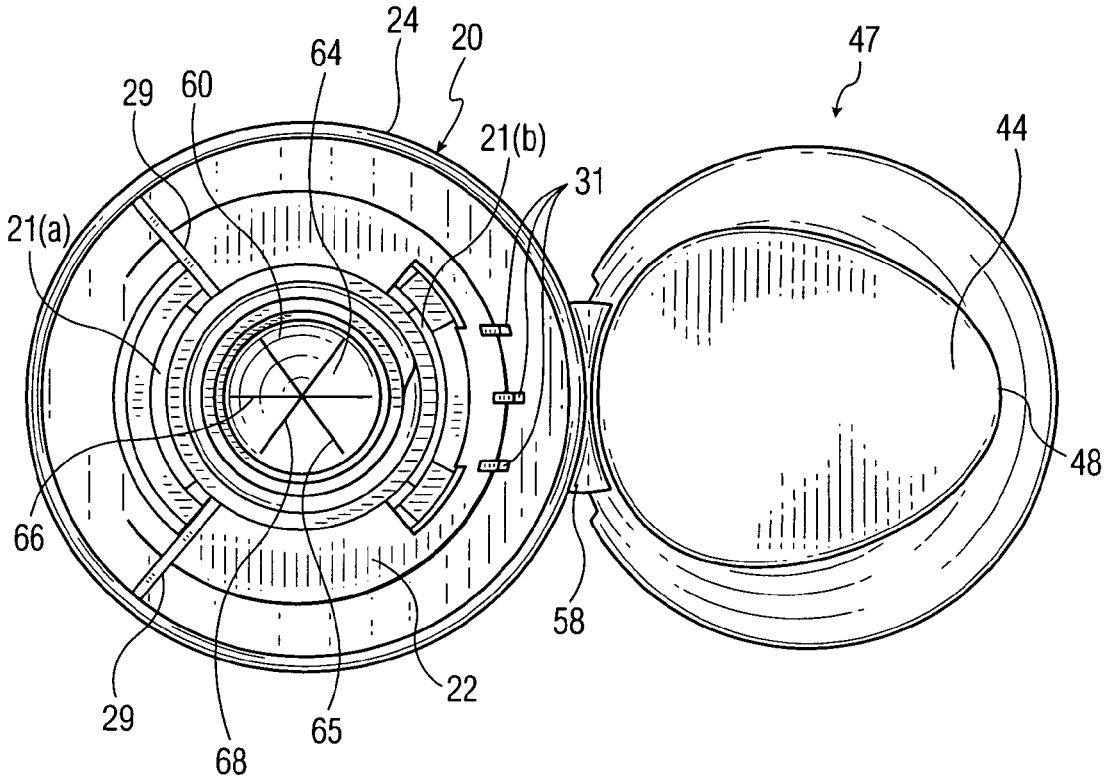
FIG. 5 is a bottom plan view of the closure of FIG. 3.

FIGS. 3 and 4 show additional views of the opened closure in a preferred embodiment and in a fully assembled state. FIG. 3 is a top plan view and FIG. 4 is a side elevation view. FIG. 5 is a bottom plan view of the closure. There is shown the underside of the base unit 20 and the valve 60 and the top surface 44 of the lid 47 of the upper unit 40. Further there is shown skirt 22 depending from base unit surface 24. Supports 29 serve to rigidify the base unit surface 24. The supports 31 serve to orient the closure upper unit to the base unit during assembly. Parts 21(*a*) and 21(*b*) are the above described voids.

Figure 6:
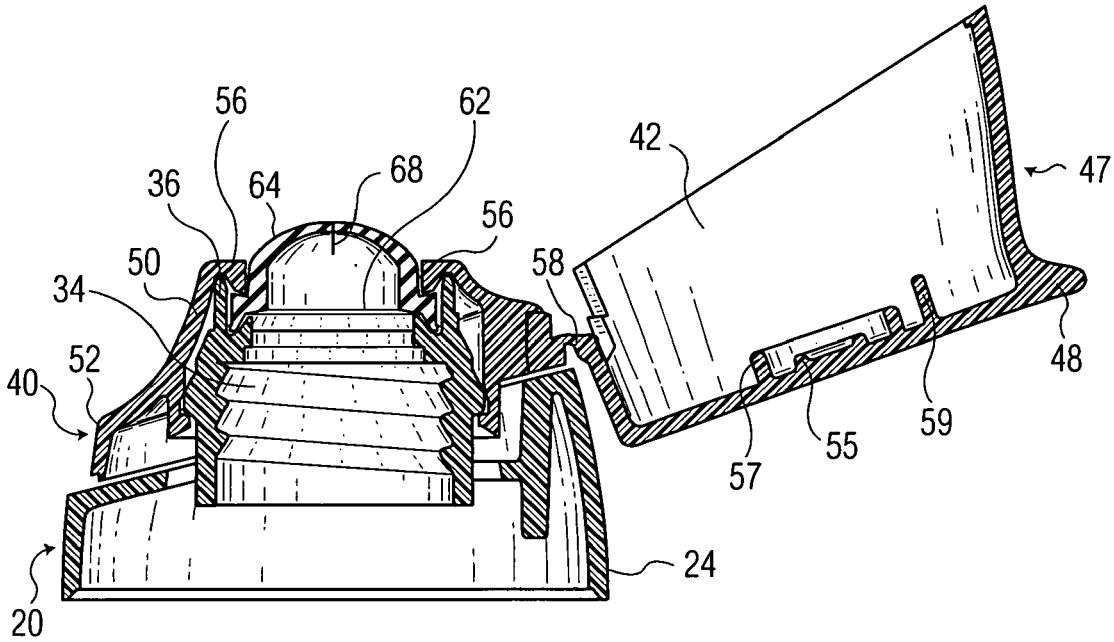
FIG. 6 is a cross-sectional view of the closure of FIG. 3 along line 6-6.
Figure 7:
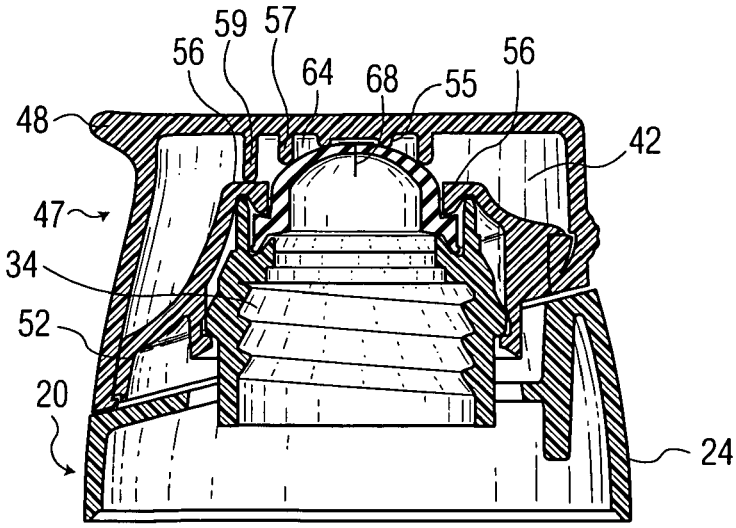
FIG. 7 is a cross-sectional view of the closure of FIG. 6 in a closed orientation.

FIGS. 6 and 7 show the closure 60 in cross-sectional views along line 6-6 of FIG. 3. In FIG. 6 the closure is shown in an open orientation and in FIG. 7 in a closed orientation. In the closed orientation it is seen that the support 59 contacts surface 56. This supports the lid opposite the hinge and is useful to reduce stress on the hinge when the closure is being assembled onto the tube or other container. Seal 55 serves to hold the segments of the valve surface 64 closed when the lid 47 is in a closed position. Seal 57 contacts the valve surface between the edge 62 and the area with the slits. In this way it forms a positive seal against the surface 64 of the valve. Shown in these views are the threads 34 for attaching the closure to a tube or other container.

In a use of the contents of the container, which preferably is a tube, the lid 47 will be opened and the tube squeezed. The flow of the product from the tube 12 will cause valve 60 to open by the slits 65, 66 and 68 opening. Upon the release of pressure on the tube, and the tube contents on the valve 60, the slits 65, 66 and 68 of the valve will close. Upon the valve 60 closing the flow of product will cease. The lid 47 then will be closed until some of the contents of the tube are to be again dispensed. The tube 12 then due to the substantially horizontal surface 44 of the lid can be stored inverted by standing on the lid. That is, it will be supported by the lid. This provides a very convenient way for storage.

Figure 8:
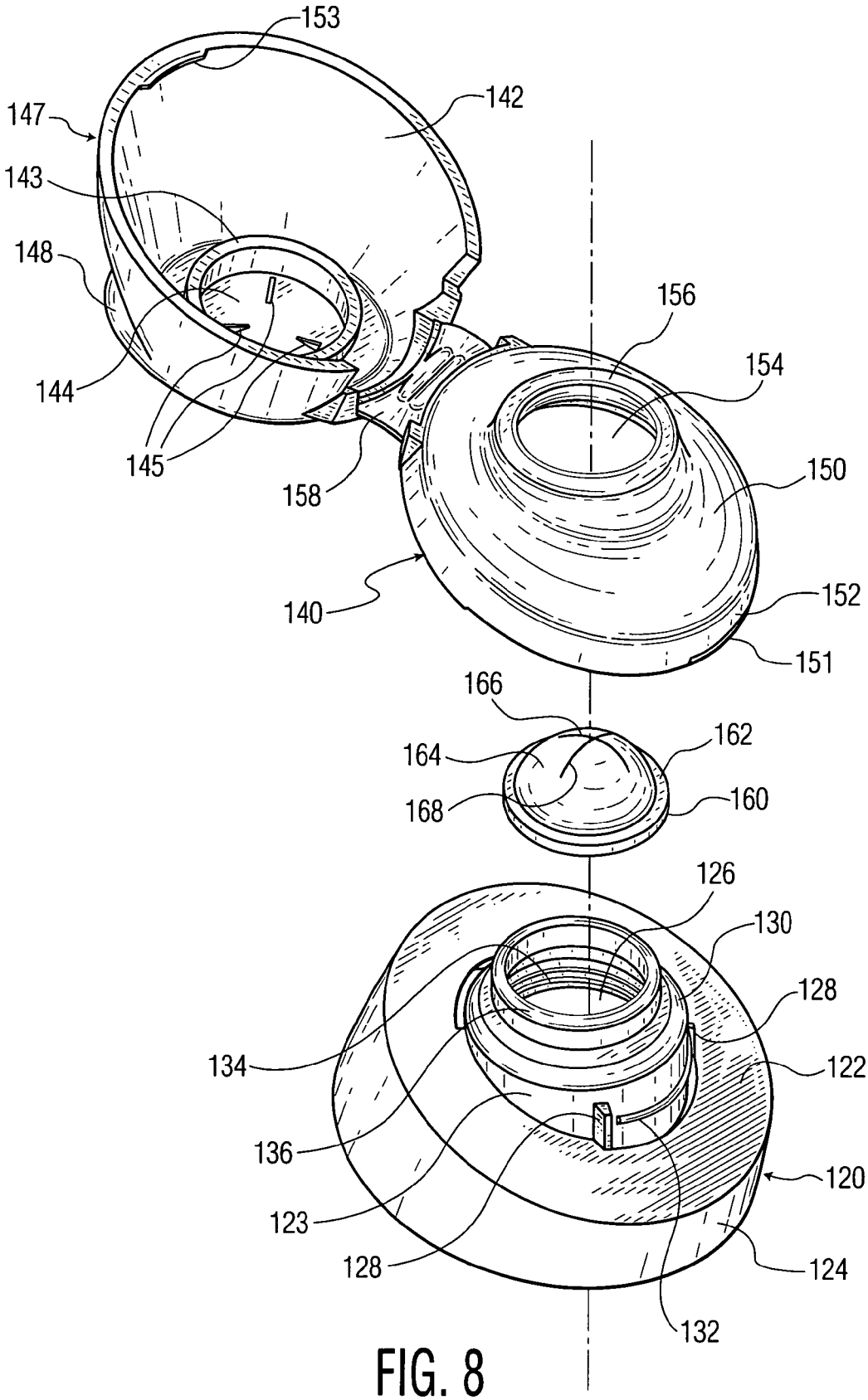
FIG. 8 is an exploded view of an alternative embodiment of the closure.

FIGS. 8 to 12 disclose an alternate embodiment of the closure which can be used with products of a lower viscosity since the four slit valve will require a greater force to actuate. FIG. 8 shows the closure in an exploded view. The closure is comprised of a base unit 120, upper unit 140 and valve 160. The base unit 120 is comprised of base unit surface 122 with depending skirt 124 and also has an aperture 126. Cylindrical section 130 extends upwardly and downwardly through the base unit surface 122 and provides part of the structure of aperture 126. On the interior of the cylindrical section 130 are threads 134 for the attachment of the base unit to a tube or other container. The cylindrical section 130 has an upper edge 136 defining the periphery of the aperture. On the lower exterior surface 123 of the cylindrical section 130 are guide ledges 128 and projection 132 to attach and lock the upper unit 140 onto base unit 120. The guide ledges 128 orient the upper unit 140 to the base unit 120 as the upper unit 140 is being assembled onto the base unit 120. Areas 121 (*a*) and 121(*b*) are voids in the base unit surface 122.

The upper unit 140 is comprised of an upper unit surface 150 with a peripheral skirt 152. This upper unit surface 150 has an aperture 154 with peripheral edge 156. The aperture 154 will align with aperture 126 of the base unit when the base unit and upper unit are attached. These usually will be in an axial orientation with a container.

The upper unit also comprises a lid 147 which is attached to the upper unit flange by hinge 158. The lid 147 is comprised of sidewall 142 and contiguous top wall 144. Depending from the top wall 144 inner surface are valve supports 145. The valve supports 145 aids in maintaining the valve 160 closed when the lid 147 is in the closed position by contact with the valve 160. This prevents the accidental dispensing of product from the container when the lid is closed. Ledge 148 of the lid is adjacent to grip surface 146 and aids in opening the lid. Projection 153 on the lid interfits with projection 151 of the upper unit to hold the lid in a closed position.

The valve 160 is comprised of a peripheral flange 162 and curved convex portion 164. The curved convex portion 164 has intersecting slits 166 and 168. There can be additional slits. When the closure is assembled the peripheral flange 162 of the valve rests on a recess on the aperture edge 136 of the base unit 120. The valve peripheral flange 162 is held in place on cylindrical section edge 136 by contact with the underside of peripheral edge 156 of aperture 154 of the upper unit 140. In essence the peripheral flange 162 of valve 160 is sandwiched between the base unit 120 and the upper unit 140.

Figure 9:
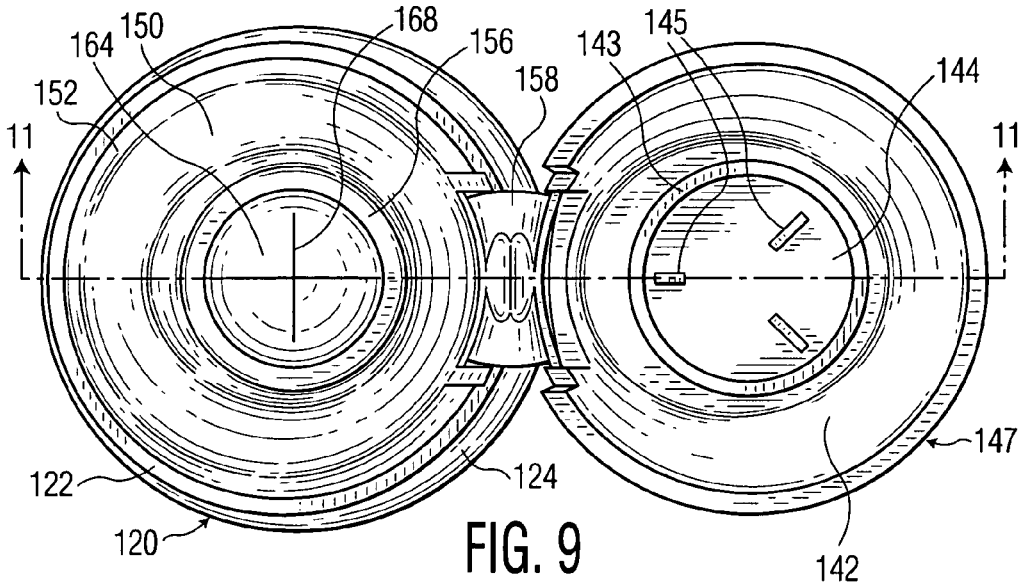
FIG. 9 is a top plan view of the closure opened.
Figure 10:
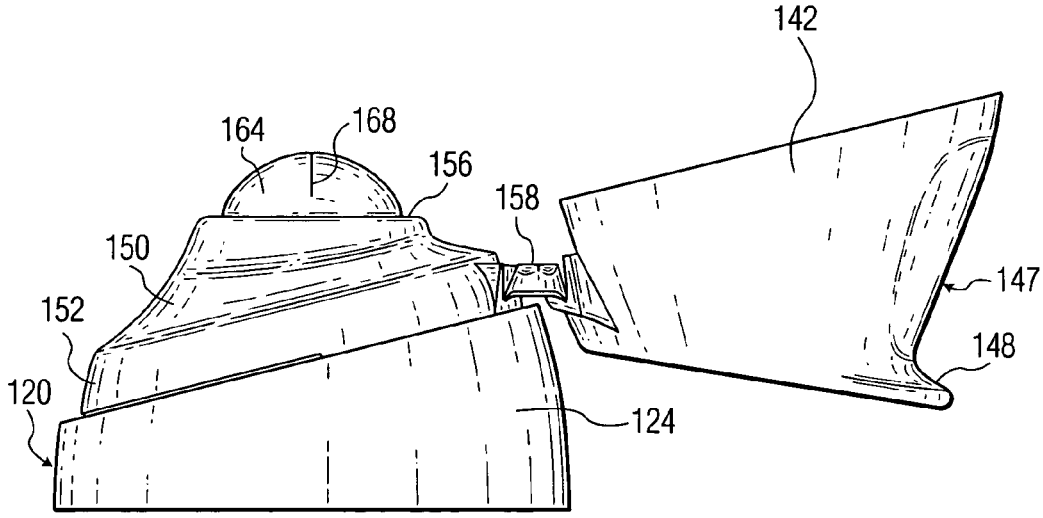
FIG. 10 is a side elevation view of the closure of FIG. 8.
Figure 11:
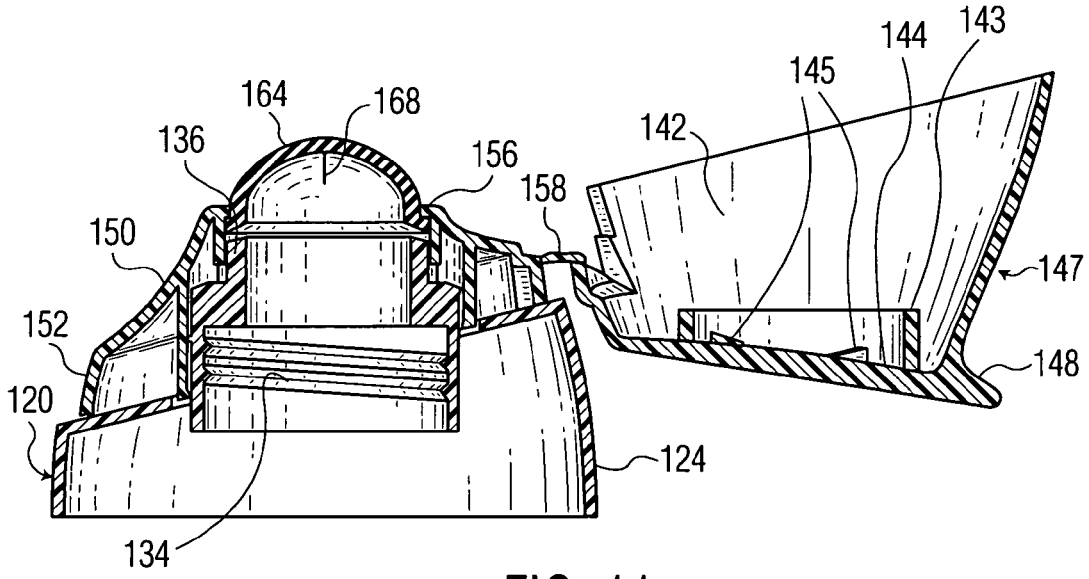
FIG. 11 is a cross-sectional view of the closure of FIG. 9 along line 11-11.
Figure 12:
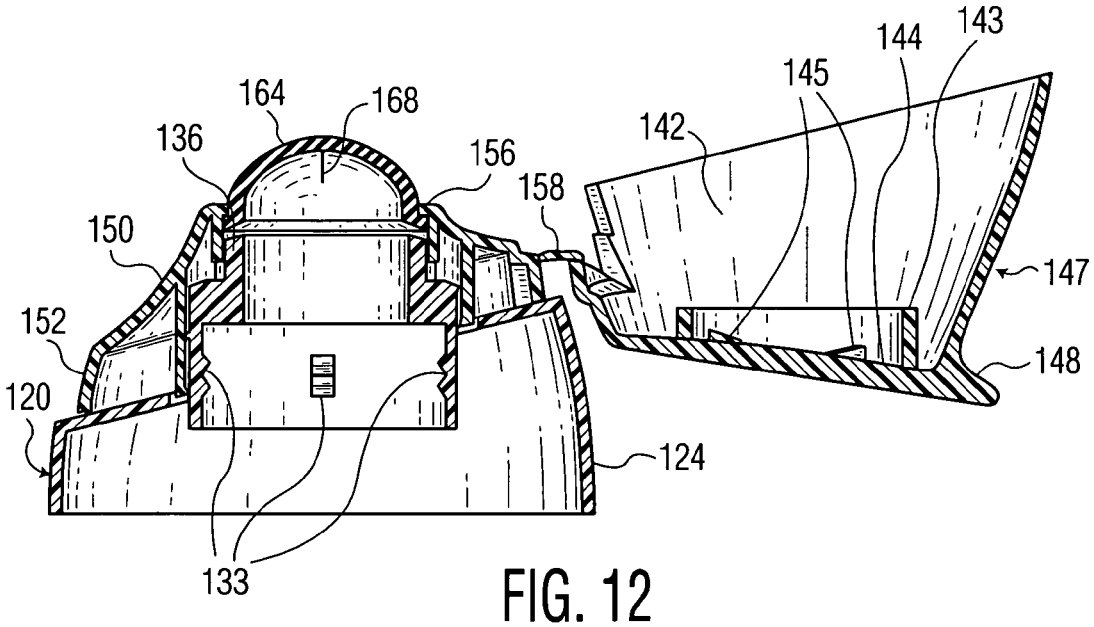
FIG. 12 is a cross-sectional view of the closure of FIG. 11 showing an alternative attachment to the container.

FIGS. 9 and 10 show additional views of the opened closure in a preferred embodiment and in a fully assembled state. FIG. 9 is a top plan view and FIG. 10 a side elevation view. FIGS. 11 and 12 show the closure 160 in cross-sectional views along line 11-11 of FIG. 8. In both Figures the closure is shown in an open orientation. Shown in FIG. 11 are the threads 134 for attaching the closure to a tube or other container. In FIG. 12 there is shown the same closure as in FIG. 11 but with the attachment of the closure to a tube or other container by means of a locking interference fit. A projection on a tube or other container will fit into recesses 133 on the closure. In the alternative the projection can be on the closure and the recess on the tube or other container.

The closure embodiment of FIGS. 8 to 12 functions in essentially the same manner as the closure of FIGS. 1 to 7.

The products in the container can have a viscosity of about 15,000 centipoise to about 90,000 centipoise and preferably about 25,000 centipoise to about 60,000 centipoise. These include both food and personal care products. The products where the closure is particularly useful are products contained in and dispensed form a tube. The products include pastes, gels and lotions. It has been found to be very useful for viscous products such as toothpastes.

The closure can be made out of a polymer, and usually a thermoplastic. The preferred manufacturing technique for the plastic units is injection molding. These are made in multicavity molds. The preferred thermoplastic polymers are the homopolymers and copolymers of ethylene, propylene, butadiene and vinyl compounds. Specific useful plastics are a range of densities of polyethylenes and polypropylenes.

The valve can have a specific gravity of about 1 to 1.2; an elongation of about 400% to about 700% and a tensile strength of about 1200 psi to about 1600 psi. The valve can be comprised of a polymeric material, and preferably a silicone polymeric material. However a range of thermoplastic and rubber polymeric materials can be used. Silicone polymeric materials are preferred since they are quite inert to most products that would be dispensed using such a valve. Useful silicone polymeric materials and valves are described in U.S. Pat. No. 5,033,655 to Liquid Molding Systems, Inc. of Midland, Mich. In this patent the preferred material is described as a silicone rubber.

The invention claimed is:

1. A closure for a dispensing container for viscous paste products comprising:

a valve having a peripheral flange, a curved convexly shaped portion, and at least one slit in the curved convexly shaped portion, the peripheral flange surrounding the curved convexly shaped portion;

a base unit comprising a base surface having a base aperture, a cylindrical section surrounding the base aperture and having structure to attach said base unit to the container;

an upper unit attached to said base unit and having an upper unit surface with an upper aperture in said upper unit surface, said base aperture and said upper aperture in alignment when said upper unit is attached to said base unit, said peripheral flange of the valve supported by an upper surface of said base unit and a lower surface of said upper unit, said upper unit having a lid having a top surface, an inner surface and a depending side surface;

a first seal depending from said inner surface to contact the convexly shaped portion of said valve only between a peripheral edge of said valve and the at least one slit when the lid is closed; and a second seal depending from said inner surface contacting the convexly shaped portion of said valve in the area of the at least one slit above the contact by the first seal when the lid is closed to further maintain said valve closed.

2. A closure as in claim 1 wherein said top surface is planar whereby said container can be supported on said lid.

3. A closure as in claim 1 wherein said cylindrical section extends above said base surface, the part of said base unit that supports said valve being an upper part of said cylindrical section.

4. A closure as in claim 1 wherein said base aperture and said upper aperture are axially located in said base unit and said upper unit.

5. A closure as in claim 1 wherein said valve is comprised of a polymeric material.

6. A closure as in claim 1 wherein said valve has 2 to 10 slits.

7. A closure as in claim 1 wherein said base unit is a first color and said upper unit is a second color.

8. A tube dispensing container containing a viscous product having a viscosity of about 15,000 centipoise to about 90,000 centipoise, wherein the dispensing container has a closure comprising:

a valve and at least two separate but interfitting units, the valve having a peripheral flange surrounding a curved convexly shaped portion and having at least one slit in the curved convexly shaped portion, the at least two separate but interfitting units comprising one interfitting unit being a base unit comprising a base surface having a base aperture, a cylindrical section surrounding the base aperture and having structure to attach said base unit to the container, another interfitting unit being an upper unit attached to said base unit and having an upper unit surface with an upper aperture in said upper unit surface, said base aperture and said upper aperture in alignment when said upper unit is attached to said base unit, said peripheral flange of the valve supported by an upper surface of said base unit and a lower surface of said upper unit, said upper unit having a lid having a top surface, an inner surface and a depending side surface;

a first seal depending from said inner surface to contact the convexly shaped portion of said valve only between a peripheral edge of said valve and the at least one slit when the lid is closed; and a second seal depending from said inner surface contacting the convexly shaped portion of said valve in the area of the at least one slit above the contact by the first seal when the lid is closed to further maintain said valve closed.

9. A tube dispensing container as in claim 8 wherein said product is a toothpaste having a viscosity of about 30,000 centipoise to about 45,000 centipoise.

10. A tube dispensing container as in claim 8 wherein said upper unit has a lid having a top surface and a depending side surface.

11. A tube dispensing container as in claim 8 wherein said valve has 2 to 10 slits.

12. A tube dispensing container as in claim 8 wherein said cylindrical section extends below said base surface.

13. A tube dispensing container as in claim 8 wherein said base aperture and said upper aperture are axially located in said base unit and said upper unit.

14. A tube dispensing container as in claim 8 wherein said valve is comprised of a polymeric material.

15. A tube dispensing container as in claim 10 wherein said top surface of said lid is planar whereby said closure and an attached container can be supported inverted on said lid.

16. A tube dispensing container as in claim 8 wherein said base unit is a first color and said upper unit is a second color.

17. A tube dispensing container as in claim 8 wherein said product is a toothpaste.

18. A closure as in claim 1 wherein a support depends from the lid inner surface at a point at about opposite the hinge and contacts the base surface to provide a support for the lid opposite the hinge to thereby reduce stress on the hinge when the lid is closed.

19. A tube dispensing container as in claim 8 wherein a support depends from the lid inner surface at a point at about opposite the hinge and contacts the base surface to provide a support for the lid opposite the hinge to thereby reduce stress on the hinge when the lid is closed.

* * * * *